US006655447B1

(12) United States Patent
Marti et al.

(10) Patent No.: US 6,655,447 B1
(45) **Date of Patent: *Dec. 2, 2003**

(54) STRIP-CASTING MACHINE FOR PRODUCING A METAL STRIP

(75) Inventors: Heinrich Marti, Forch (CH); Jacques Barbé, Tarantaise (FR)

(73) Assignees: SMS Demag AG and Main Management, Düsseldorf (DE); Inspiration AG, Hergiswil (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/088,833

(22) PCT Filed: Sep. 19, 2000

(86) PCT No.: PCT/EP00/09161

§ 371 (c)(1),
(2), (4) Date: Jun. 5, 2002

(87) PCT Pub. No.: WO01/23122

PCT Pub. Date: Apr. 5, 2001

(30) Foreign Application Priority Data

Sep. 24, 1999 (CH) ..... 1750/99

(51) Int. Cl.[7] ..... B22D 11/06
(52) U.S. Cl. ..... 164/428; 164/480
(58) Field of Search ..... 164/428, 480

(56) References Cited

U.S. PATENT DOCUMENTS 5,915,454 A * 6/1999 Wright et al. ..... 164/428
6,032,722 A * 3/2000 Russell et al. ..... 164/428
6,354,365 B2 * 3/2002 Capotosti et al. ..... 164/480

FOREIGN PATENT DOCUMENTS

| | | |
|---|---|---|
| DE | 199 19 354 A1 | 11/1999 |
| EP | 0575617 | 12/1993 |
| EP | 0692330 | 1/1996 |
| WO | 9620800 | 7/1996 |

OTHER PUBLICATIONS

Patent Abstracts of Japan, vol. 009, No. 226 (M–412), Sep. 12, 1985 & JP 60 083754 A (Ishikawajima Harima Jukogyo KK), May 13, 1985.

* cited by examiner

*Primary Examiner*—Kuang Y. Lin
(74) *Attorney, Agent, or Firm*—Friedrich Kueffner

(57) ABSTRACT

The invention relates to a strip-casting machine (20) for producing a metal strip. Said strip-casting machine consists of a pair of casting rolls (22, 24) arranged in side-by-side parallel relation with a casting gap thereinbetween and of lateral sealing elements (25) that are provided with respective sealing plates (61) at both sides of the casting rolls (22, 24) that are pushed or pressed against the casting rolls from the front by means of pushing or pressing means. The respective sealing plate (61) is pushed or pressed against the two equilateral front faces (22', 24') of the casting rolls (22, 24) in such a manner that, in the heated operational state, it facilitates an extremely exact positioning on the front faces of the casting rolls. To this end, the sealing plate (61) is mounted in such a manner as to allow a three-dimensional displacement of the sealing plate, as if floating.

14 Claims, 4 Drawing Sheets

STRIP-CASTING MACHINE FOR PRODUCING A METAL STRIP

BACKGROUND OF THE INVENTION

1. Field of the Invention

The invention pertains to strip-casting machine for producing a metal strip with two casting rolls set up next to each other to form a casting gap and with lateral sealing elements, each of which comprises a sealing plate which can be pressed against the end surfaces of the casting rolls on one side, where the sealing plate in question can be pressed against the two end surfaces of the casting roll in such a way that very precise contact can be achieved between the plate and the end surfaces of the casting rolls at the high temperatures of the casting operation.

2. Description of the Related Art

In a strip-casting machine of the general type in question according to EP-A 0,714,716, the device for sealing off the sides of the casting rolls consists of refractory sealing plates, one of which is pressed against the end surfaces of the two casting rolls on each side; these sealing plates prevent the molten steel poured in between the casting rolls from escaping toward the side. A metal bath is formed instead, as in a conventional mold. As these sealing plates are pressed against the rotating casting rolls, they are subjected to wear, which is accompanied by the large thermal load caused by the metal bath. The sealing plates are connected to a pressing device, which is designed in such a way that a disadvantageous wear pattern is necessarily formed on the sealing plates. One of the main problems of strip-casting machines of this type therefore remains unsolved, namely, the problem of ensuring that the lateral sealing elements offers a reliable seal throughout the entire duration of the casting operation.

In the case of casting rolls with small diameters in the range of approximately 500–800 mm, the seals to be provided for the roll sides are proportionately smaller. Because of the small volume of the metal bath, however, the surface of the molten bath is unsteady. In the case of large casting rolls with diameters of, for example, approximately 1,500 mm, the surface of the molten bath is calmer because of its larger volume. Although this is advantageous, larger and more complicated lateral sealing elements become necessary. As a result of manufacturing and installation tolerances, irregular wear, and differences in the degrees to which casting rolls are heated as a result of deposits, it is possible that the sealing edges or sealing surfaces of the rolls are not precisely aligned with each other.

From Japanese Patent Early Disclosure JP 4 [1992]-224, 052 A, a strip-casting machine with two casting rolls is known, in which the frictional forces between a sealing plate and the end surfaces of the casting rolls are measured, and the pressing forces acting on the sealing plates are modified accordingly. This goal is to reduce asymmetrical wear on the sealing plate and to avoid the danger of the leakage of molten metal. The pressing forces are transmitted to the sealing plate by three hydraulic cylinders. The sealing plate is guided rigidly in an axial direction in a guide sleeve, which is disadvantageous.

In the document EP 0,806,997, a twin-roll casting system is described. The sealing plate for the two casting rolls consists of an upper and a lower part. The lower part of the sealing plate is pressed with much higher pressure against the end surfaces of the two casting rolls where they form the edges of the triangular gap than the upper part is. The upper sealing plate part is pressed by three cylinders against the rolls. The pressure applied by the cylinders is distributed uniformly over all the cylinders. The wear pattern of the sealing plate is necessarily irregular, even when a so-called "spring return" for the individual pressure cylinders is provided as a restoring force. The danger of leakage as a result of premature wear of the sealing plates remains high.

The document EP 0,692,330 B1 deals with the casting of strip between two casting rolls, the end surfaces of which are sealed off by sealing walls. For the continuous determination of the state of the contact between the end surfaces of the rolls and the sealing walls, the frictional conditions are measured and compared with specified settings. At least one casting parameter is controlled on the basis of the results of the comparison. The position of the sealing wall can also be controlled on the basis of the value of the friction conditions. For this purpose, the sealing wall is held by an arrangement which consists of a main slide, which can slide in the direction of the rolls, and a secondary slide, which is guided horizontally on the main slide. Thus the sealing wall can be adjusted in two planes in order to measure the pressure or the forces on the sealing wall in the vertical and horizontal directions. The measurement setup does not, however, eliminate the danger of leaks at the sealing walls as a result of irregular wear.

A twin-roll continuous casting machine with side walls pressed against the rolls for the continuous casting of thin metal strips is also described in another document, namely, EP 0,698,433 B1. The side walls are connected to a pressure plate and a support plate, so that the side walls can be moved in the axial direction of the casting rolls and also perpendicular to that direction. Between the pressure plate and the support plate, several compression springs are inserted, which act on the side walls. Each side wall is surrounded by a cooled ring. The pressure plate is carried by a cart, which can move in the axial direction. On the cart there is an adjusting cylinder, which acts on the pressure plate. The previously known design, however, is unable permanently to prevent irregular wear of the side walls and thus unable to guarantee the required absence of leakage between the casting rolls and the side walls over the course of several casting sequences.

SUMMARY OF THE INVENTION

Against this background, the present invention was based on the task of improving a strip-casting machine of the general type indicated above in such away that the required absence of leakage at the lateral sealing elements is ensured during the entire casting operation, even when casting rolls of optimum diameter are used. Another goal is that it should be possible with the improved machine to deliver the lateral sealing elements quickly and after replacement has been completed to carry out operations reliably with them.

The task is accomplished according to the invention in that each sealing plate is supported in a floating manner so that it can be set or pressed against the rolls with freedom to move in three dimensions. As a result, very precise contact can be achieved between the sealing plate and the end surfaces of the casting rolls even at the high temperatures of the casting operation, and the wear of the sealing plate is reduced to a minimum.

In a highly advantageous embodiment, each lateral sealing element is attached to a carrier element. This carrier element consists of the sealing plate, a support frame holding the sealing plate, the setting or pressing means acting on the frame, and the floating support of these components on the carrier element.

In a further elaboration of the invention, it is provided that at least one of the casting rolls can be adjusted, especially in the axial direction, so that the end surfaces of the rolls can be aligned with each other on a plane as accurately as possible and/or aligned with respect to the sealing plates.

With this strip-casting machine according to the invention, optimum lateral sealing of the casting rolls is achieved, the functionality of the seals remaining effective for the entire duration of the casting operation even in the case of casting rolls with diameters of more than 1 meter.

BRIEF DESCRIPTION OF THE DRAWING

An exemplary embodiment of the invention and additional advantages of same are explained in greater detail below on the basis of the drawing.

DETAILED DESCRIPTION OF THE PREFERRED EMBODIMENTS

Figure 1:
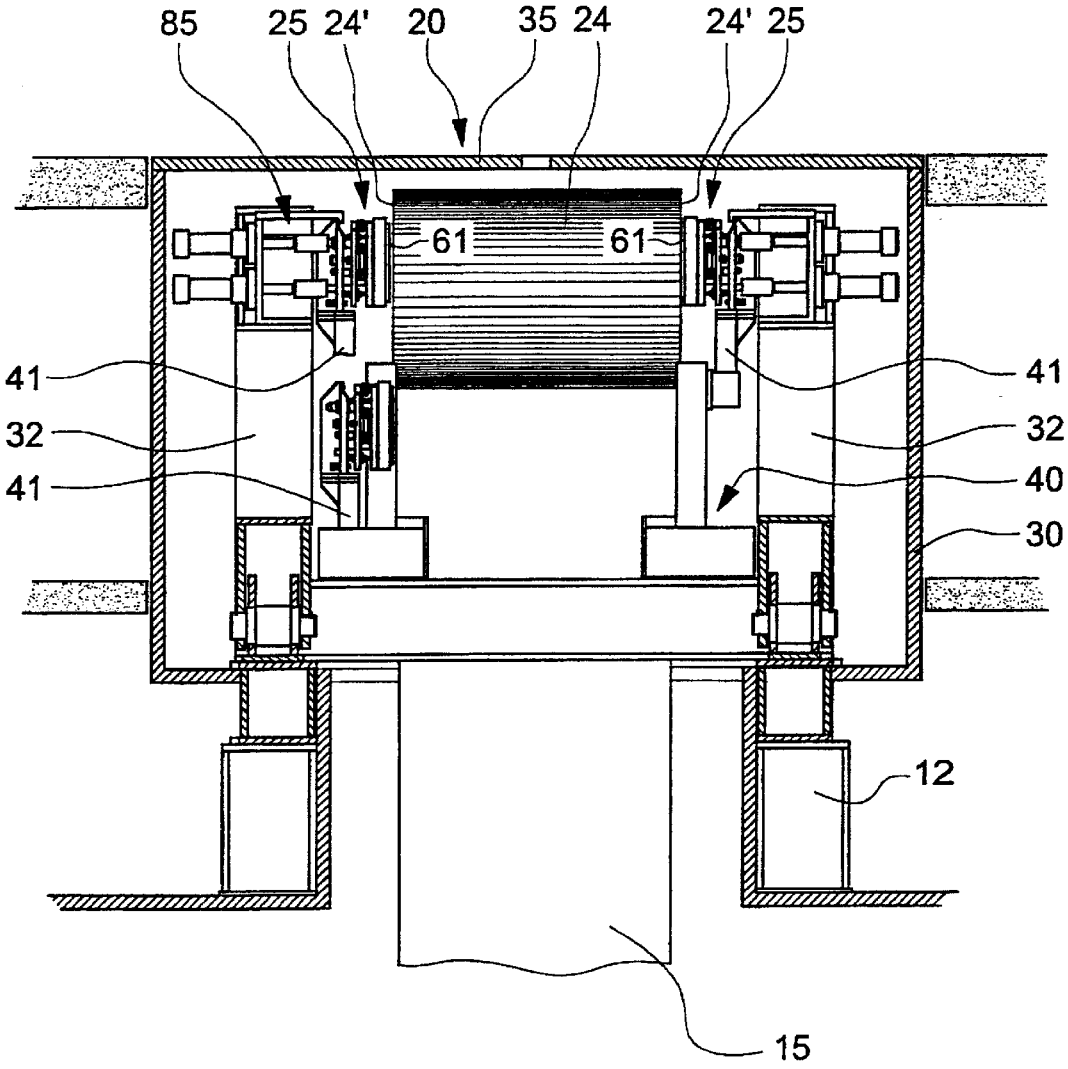
FIG. 1 shows a section through a strip-casting machine with the lateral sealing elements according to the invention.

FIG. 1 shows a strip-casting machine 20 for producing a metal strip 15, especially a steel strip, which can be produced by a continuous casting operation. This strip-casting machine 20 stands on a suggested steel structure 12 and is supplied with molten metal by a tundish vessel mounted above it, as known from conventional continuous casting systems. It is advisable for the tundish vessel to have a stopper or the like to close the discharge opening, through which the molten metal can flow.

The strip-casting machine 20 consists primarily of two casting rolls 22, 24, set up essentially parallel to each other with rotational axes approximately on a horizontal plane. Lateral sealing elements 25 can be pressed against the two end surfaces of the rolls on each side, as a result of which an enclosed space is created with a casting gap open at the bottom. The casting rolls 22, 24 are supported on both sides on a standard 32, and each is driven in a controlled manner by an motor. The strip-casting machine 20 standing on a suggested steel structure 12 or the like is enclosed by a housing 30, so that the strip-casting operation can be carried out under an inert gas, sealed off from the air. On top of the housing 30 are sliding doors 35, so that the housing can be opened and closed.

Each of these lateral sealing elements 25 has a sealing plate 61, which can be pressed by a pressing device against the end surfaces of the casting rolls 22, 24 to form a mechanical seal. These triangular sealing plates 61, made of a refractory material, cover approximately the upper part of the end surfaces 22', 24' of the casting rolls.

According to the invention, each of the sealing plates 61 can be pressed against the two end surfaces 22', 24' on one side in such a way that very precise contact can be achieved between the plate and the end surfaces of the casting rolls even at the high temperatures of the casting operation.

Figure 3:
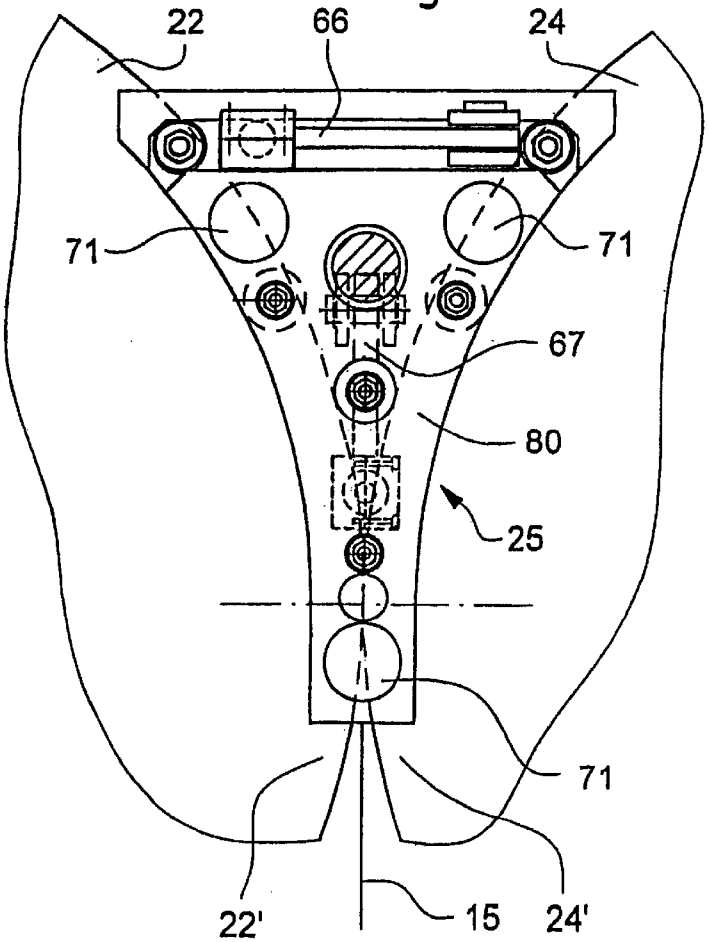
FIG. 3 shows a section through the lateral sealing element along line III—III of FIG. 2.
Figure 2:
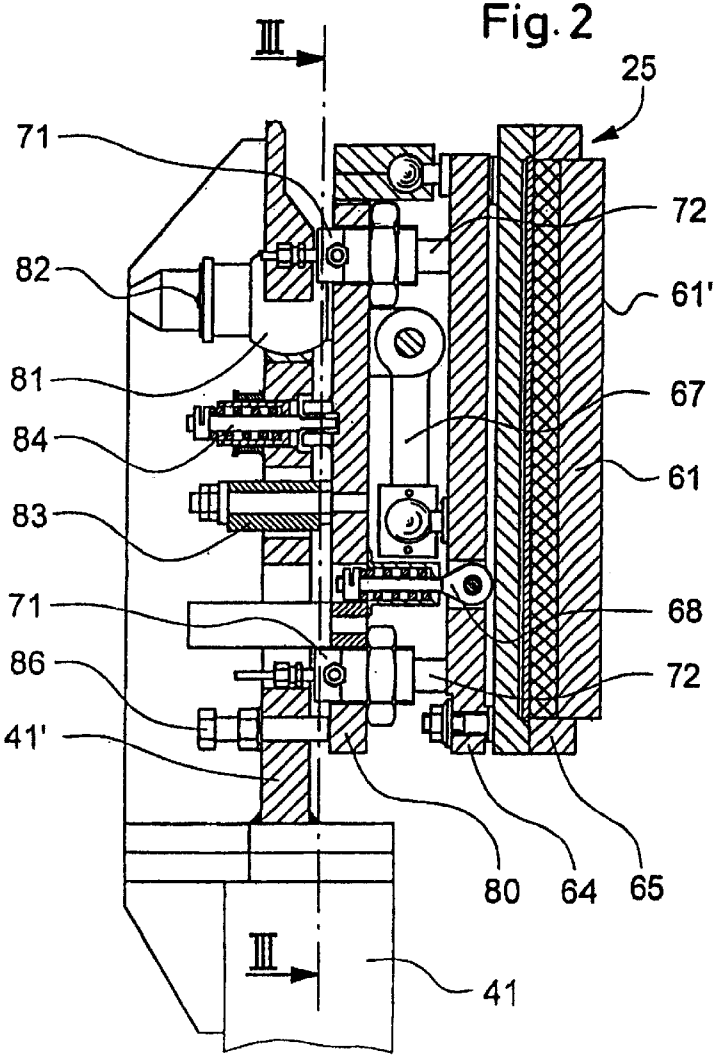
FIG. 2 shows a longitudinal section through a lateral sealing element according to FIG. 1.

According to FIGS. 2 and 3, each sealing plate 61 is for this purpose arranged so that it can be moved by the pressing means against the end surfaces 22', 24' of the casting rolls. Each plate is also supported in a floating manner via an articulation means, in the present case a ball joint 81, so that a constant pressure can be applied and so that the sealing surfaces 61' can be kept precisely parallel to the two end surfaces of the casting rolls, which lie on the same plane.

The pressing means has at least one and preferably three pressure cylinders 71, each cylinder having a piston 72, which can be displaced in a direction approximately perpendicular to the sealing plate 61. By way of a support frame 64, 65, the pressure cylinders exert a nearly constant, controllable pressure on the associated sealing plate 61 in the manner of a three-point bearing; these pressure cylinders 71 advisably act on the corner areas of the sealing plate 61, which, because of the arrangement of the casting rolls, is approximately triangular.

The support frame 64, 65 carrying the sealing plate 61 is connected by articulated joints 66, 67 to a butt plate 80, which is supported on the carrier element 41, 41' in a floating manner by the ball joint 81; the support frame 64, 65 is pressed continuously against the pistons 72 of the pressing means by an elastic connection, namely, an adjustable tension spring 68 with anchor, located between the frame and the butt plate 80. The articulated joints consist in each case of an approximately horizontal articulated lever 66 and an vertical articulated lever 67, these articulated levers 66, 67 also being spherically supported on the support frame 64 at one end and on the butt plate 80 at the other end, so that the sealing plate 61 can be moved parallel to the butt plate 80 in three different directions. With optimum support of the sealing plate 61, it is possible to exclude permanently the possibility that the plate could become jammed or locked even when the entire lateral sealing element is at elevated temperature.

A projecting centering pin 82, furthermore, is provided on the ball joint 81, by means of which the carrier element 41 can be centered with respect to the device 85. A cam 83 or the like makes it possible to center the lateral sealing element 25 vertically with respect to the carrier element 41. A flexible retaining element 84 is provided between the butt plate 80 and the top part 41' of the carrier element 41. A stop screw 86 on this top part 41' limits the range over which the plate 80 can swing.

FIG. 1 also clearly shows that the carrier element 41 holding the lateral sealing elements 25 is associated with a manipulator 40, by means of which the lateral sealing element in question can be moved laterally away from the casting rolls 22, 24 and returned. After the lateral sealing elements 25 have been brought laterally up into position next to the casting rolls 22, 24, they are centered by a device 85 mounted on the standard 32 for the casting rolls, and the cylinders 71 are connected to their respective drive elements. Conversely, after the device 85 has been disconnected, the lateral sealing elements 25 can be moved away by the manipulator for maintenance. The device 85 is mounted on the standard 32, but it could also be mounted on the manipulator.

A monitoring and control system for these lateral sealing elements 25 makes it possible to adjust the pressing means acting on the sealing plate 61 in optimum fashion and also to monitor the system for problems, leaks, etc., both for the sake of prevention and for the sake of early detection in conjunction with an on-line error correction system, especially in regard to the sealing plate.

Figure 4:
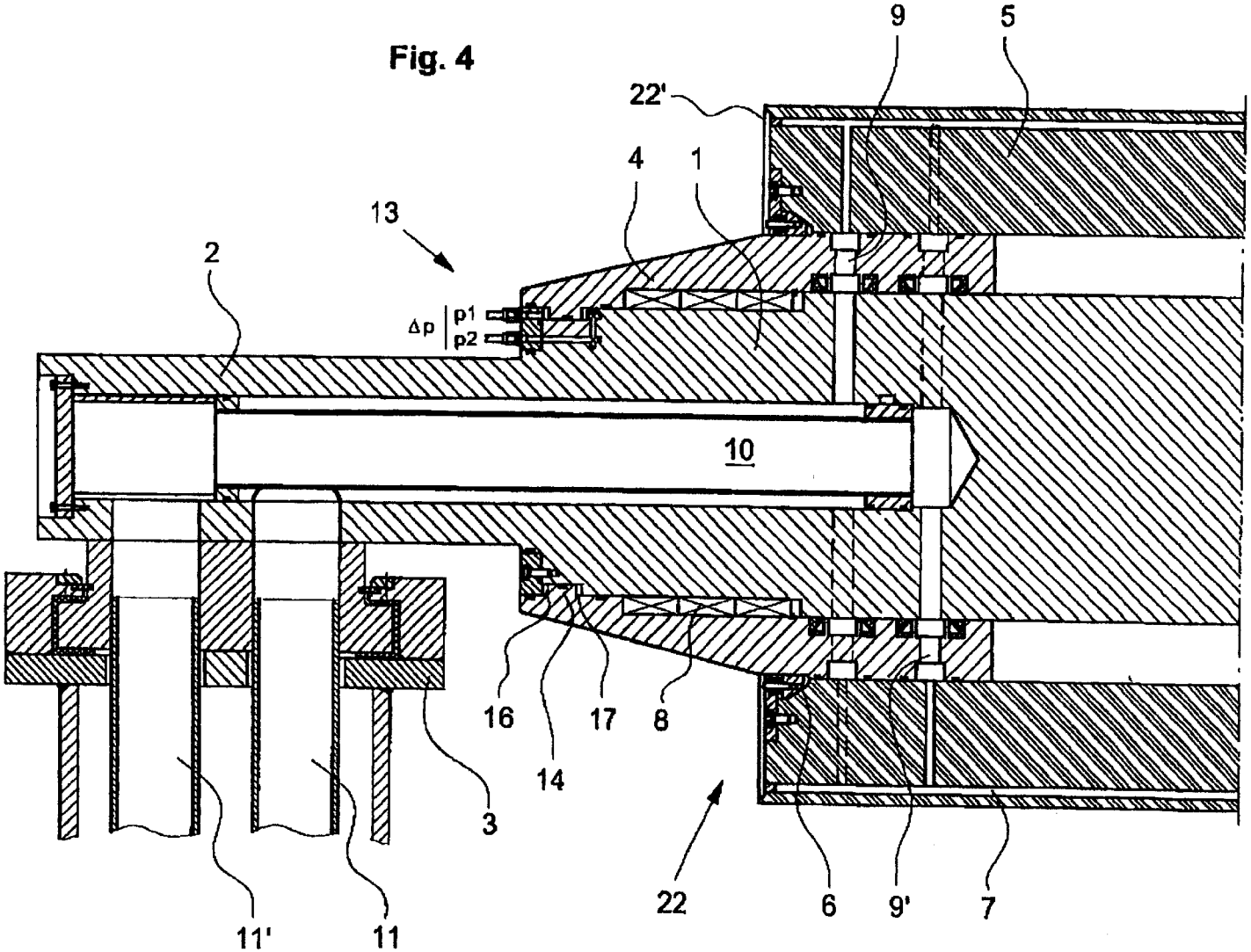
FIG. 4 shows a device for the axial displacement of the cylindrical, cooled jacket of a casting roll on its stationary axle.

FIG. 4 shows a device for the axial displacement of the end surfaces 22' of the casting rolls 22 to be sealed and for their alignment with respect to each other. The casting roll 22 consists of a stationary axle 1 with an axle journal 2, which is supported on a stand 3. The casting roll 22 comprises a ring-shaped support element 4, which is connected to the cylindrical jacket 5 by means of a wedge-type clamping device 6. The jacket 5 is provided around its circumference with axially oriented cooling bores 7, which are connected to additional bores 9, 10, 11 in the support element 4, in the axle 1, and in the stand 3, which supply and carry away a coolant. The jacket 5 and the support element 4 are mounted rotatably on the axle 1 by the bearings 8 and are driven by a motor/transmission device (not shown). So that the end surfaces 22' of the casting roll 22 can be aligned on the same plane with the end surfaces of the other casting roll (not shown), the jacket 5 is mounted on the stationary axle 1 with freedom to shift position together with the support element 4. The displacement is accomplished with a ring-shaped, double-acting piston-cylinder unit 13, which is connected to both the support element 4 and the axle 1 and is installed at the end of the casting roll 22. A piston ring 14 on the support element 4 engages with clearance in a circumferential groove 16 in the axle 1, so that cylindrical chambers 17 are formed at the sides of the piston ring 14. Pressure can be built up in either of these chambers by a pressure medium via pressure lines p1 and p2. As a result of the pressure difference ±p between the chambers, the support element 4 and thus the end surface 22' of the casting roll 22 are shifted by a maximum value of, for example, 8 mm toward one side or the other. It is also possible for a second displacement device or pressure device to be set up at the other end of the casting roll.

Figure 5:
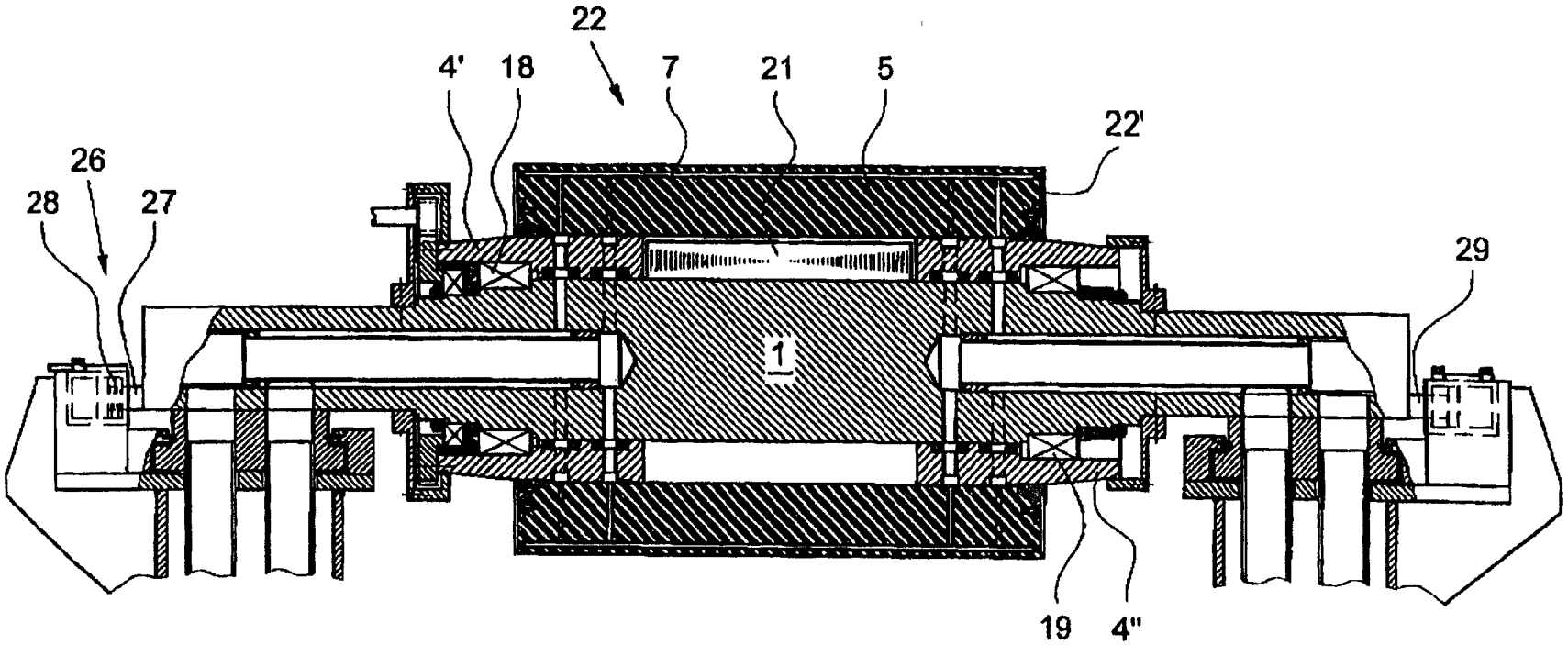
FIG. 5 shows a device for the axial displacement of the stationary axle of a casting roll with a cylindrical jacket which rotates around the axle.

An alternative design of a displacement device 13 is shown in FIG. 5. The cylindrical, cooled jacket 5 with its cooling bores 7 is shown on the stationary roll axle 1. The jacket 5 is supported by support elements 4 on the axle 1. One of the support elements 4' is connected to the jacket 5 and is, for example, held with freedom of rotation on the axle 1 by means of a radial bearing 18. The other support element 4" is connected to the axle 1, where the cylindrical jacket 5 is supported with freedom of rotation on the support element 4" by means of an axial bearing 19. Between the support elements 4' and 4", there is an electromagnetic brake 21 on the axle 1. So that the end surfaces 22' of the casting roll 22 can be brought into alignment on the same plane with the end surfaces 22' of the other casting roll (not shown), the axle 1 is shifted together with the cylinder 5 in the axial direction. For this purpose, and adjusting device 26, designed, for example, as a piston-cylinder unit 27 with a restoring spring 28, acts on the one side of the axle 1. On the other side of the axle 1, there is a pressure device 29

What is claimed is:

1. A strip-casting machine for producing a metal strip comprising two casting rolls mounted next to one another to form a casting gap, and lateral sealing elements, wherein each lateral sealing element comprises a sealing plate configured to be pressed against end surfaces of the casting rolls, wherein each sealing plate is mounted in a floating manner with freedom of movement in three dimensions, further comprising a carrier element for each lateral sealing element, the carrier element being comprised of the sealing plate, a support frame holding the sealing plate, a pressing means acting on the support frame, and a floating support of the pressing means on the carrier element, wherein the pressing means comprises at least one independently controlled cylinder, wherein a piston of the at least one cylinder is configured to exert a controllable pressure on the sealing plate, wherein the support frame is supported by articulated connections on a butt plate, the butt plate being held in a floating manner by a ball joint on the carrier element, further comprising an elastic connection between the support frame and the butt plate for permanently pressing the support frame against the piston.

2. The strip-casting machine according to claim 1, wherein the pressing means comprises three independently controllable cylinders for effecting a controllable setting position of the sealing plate relative to the end surfaces of the casting rolls.

3. The strip-casting machine according to claim 1, wherein the articulated connections are comprised of an approximately horizontally oriented articulated lever, wherein the articulated lever is supported at one end thereof on the support frame and on another end thereof on the butt plate, further comprising a spherical bearing at least at one end of the articulated lever.

4. The strip-casting machine according to claim 1, wherein the articulated connections are comprised of at least one vertically oriented articulated lever, wherein the articulated lever is supported at one end thereof on the support frame and on another end thereof on the butt plate, further comprising a spherical bearing at least at one end of the articulated lever.

5. The strip casting machine according to claim 1, wherein the carrier element is part of a manipulator for moving the lateral sealing element laterally toward and away from the casting rolls.

6. The strip casting machine according to claim 5, further comprising a device mounted on a machine stand for centering the lateral sealing elements in a position next to the casting rolls, wherein the cylinders are each connected to a drive element.

7. The strip-casting machine according to claim 1, wherein the sealing plate is of a refractory material and has a triangular shape with corner areas, wherein a cylinder acts on each of the corner areas.

8. The strip-casting machine according to claim 1, comprising means for axially aligning at least one of the casting rolls.

9. The strip-casting machine according to claim 8, wherein the alignment means comprises at least one adjusting device acting on one end of the casting roll and a pressure device acting on another end of the casting roll.

10. The strip-casting machine according to claim 9, wherein the adjusting device is a hydraulic cylinder or a worm drive, and the pressure device is a plunger.

11. The strip-casting machine according to claim 9, wherein the casting roll comprises an axle, and wherein the adjusting device and the pressure device act on the axle.

12. The strip-casting machine according to claim 9, wherein the casting roll is comprised of a stationary axle and a cooled jacket configured to rotate around the axle, further comprising shifting means for shifting the jacket on the axle.

13. The strip-casting machine according to claim 11, wherein the shifting means is arranged at least on one end of the casting roll, the shifting means comprising a piston ring mounted on the jacket and a circumferential groove provided on the axle for holding the piston ring, thereby forming two cylinder chambers.

14. The strip-casting machine according to claim 13, wherein the cylinder chambers of the shifting means are configured to be subjected to different hydraulic pressures.

* * * * *